US010370142B2

(12) United States Patent
Palisin, Jr.

(10) Patent No.: US 10,370,142 B2
(45) Date of Patent: Aug. 6, 2019

(54) SHIPPING CONTAINER

(76) Inventor: Stephen P. Palisin, Jr., Willoughby Hills, OH (US)

( * ) Notice: Subject to any disclaimer, the term of this patent is extended or adjusted under 35 U.S.C. 154(b) by 471 days.

(21) Appl. No.: 11/475,801

(22) Filed: Jun. 27, 2006

(65) Prior Publication Data

US 2007/0295632 A1 Dec. 27, 2007

(51) Int. Cl.
*B65D 8/00* (2006.01)
*B65D 21/02* (2006.01)
*B65D 43/02* (2006.01)

(52) U.S. Cl.
CPC ..... *B65D 7/04* (2013.01); *B65D 21/0233* (2013.01); *B65D 43/0212* (2013.01); *B65D 2543/00092* (2013.01); *B65D 2543/00277* (2013.01); *B65D 2543/00509* (2013.01); *B65D 2543/00555* (2013.01); *B65D 2543/00564* (2013.01); *B65D 2543/00657* (2013.01); *B65D 2543/00685* (2013.01); *B65D 2543/00768* (2013.01); *B65D 2543/00796* (2013.01); *B65D 2543/00972* (2013.01)

(58) Field of Classification Search
USPC ..... 206/515, 519; 220/671, 781, 669, 670, 220/673, 4.27, 4.26, 604, 606
See application file for complete search history.

(56) References Cited

U.S. PATENT DOCUMENTS 411,096 A * 9/1889 Eaton et al. ..... 220/671
1,673,256 A * 6/1928 McCrery et al. ..... 220/673
1,953,925 A * 4/1934 Boegehold ..... B21D 53/34 148/629
2,412,178 A * 12/1946 Seigh ..... 206/519
2,596,043 A * 5/1952 Piker ..... 220/4.01
3,305,158 A * 2/1967 Whiteford ..... 220/671
3,670,922 A * 6/1972 Phillips ..... 206/519
3,672,536 A * 6/1972 Kinney et al. ..... 220/203.09
3,688,942 A * 9/1972 Mitchell et al. ..... 220/784
3,704,808 A * 12/1972 Gibson ..... B65D 21/0233 206/519
3,792,797 A * 2/1974 Mrusek et al. ..... 220/784
3,811,597 A * 5/1974 Frankenberg et al. ..... 220/284
3,826,404 A * 7/1974 Rowe et al. ..... 220/604
3,915,336 A * 10/1975 Spreng ..... 220/284
(Continued)

FOREIGN PATENT DOCUMENTS

CN 2409163 Y 12/2000

OTHER PUBLICATIONS

Stackable Drum Company, Cyclepac Advertisement, 1997, pp. 1 and 2.

(Continued)

*Primary Examiner* — Jeffrey R Allen
(74) *Attorney, Agent, or Firm* — Curatolo Sidoti Co., LPA; Salvatore A. Sidoti

(57) ABSTRACT

A nestable shipping container including side walls, a bottom wall, and an open top is disclosed. The nestable shipping container has a geometry which permits insertion into and reception of similarly shaped containers to facilitate empty shipment and storage in a minimum amount of space. The nestable shipping container may be manufactured by a cold working method from a single blank of material. The containers may be manufactured to meet the performance criteria required of international commerce shipping drums.

25 Claims, 12 Drawing Sheets

(56) References Cited

U.S. PATENT DOCUMENTS 3,949,877 A * 4/1976 Santoni ..... 206/519
3,985,257 A 10/1976 Shaffer et al.
4,113,095 A * 9/1978 Dietz ..... B65D 1/34 206/508
4,199,073 A 4/1980 Gombas
4,203,526 A 5/1980 Stoll, III
4,209,104 A 6/1980 Speas
4,209,107 A * 6/1980 Crisci ..... 220/781
4,257,527 A * 3/1981 Snyder ..... B65D 39/084 220/604
4,264,016 A 4/1981 Speas
4,264,017 A * 4/1981 Karas et al. ..... 220/62.17
4,281,979 A * 8/1981 Doherty et al. ..... 425/391
4,294,097 A 10/1981 Gombas
4,299,589 A 11/1981 Nelson et al.
4,315,574 A * 2/1982 Forny et al. ..... 220/673
4,341,321 A 7/1982 Gombas
4,366,696 A * 1/1983 Durgin ..... B65D 21/0233 72/339
4,402,419 A * 9/1983 MacPherson ..... 220/604
4,454,742 A 6/1984 Gombas
4,485,924 A * 12/1984 Ripoll ..... B65D 21/0222 206/511
4,500,007 A 2/1985 Stoll, III
RE31,934 E 7/1985 Marston
4,540,323 A 9/1985 Inoue et al.
4,573,603 A 3/1986 Starling et al.
4,676,392 A * 6/1987 Giggard ..... B65D 25/2873 220/284
4,718,571 A 1/1988 Bordner
4,747,510 A * 5/1988 MacK ..... 220/270
4,886,184 A * 12/1989 Chamourian ..... 220/781
4,890,786 A 1/1990 Oberhofer et al.
4,909,393 A 3/1990 Palisin, Jr.
4,941,588 A 7/1990 Flider
4,953,738 A * 9/1990 Stirbis ..... 220/606
5,038,937 A 8/1991 DiSesa, Jr.
5,040,682 A * 8/1991 Palisin et al. ..... 206/519
5,044,502 A 9/1991 Hale
5,046,632 A * 9/1991 Bordner ..... 220/276
5,048,679 A * 9/1991 Thomas ..... 206/303
D320,744 S 10/1991 Palisin, Jr.
D320,745 S 10/1991 Palisin, Jr.
D321,652 S 11/1991 Palisin, Jr.
5,065,888 A * 11/1991 Gallagher ..... 220/792
D322,032 S * 12/1991 Palisin, Jr. ..... D9/429
D322,033 S 12/1991 Palisin, Jr. et al.
5,096,083 A 3/1992 Shaw et al.
5,119,657 A 6/1992 Saunders
5,147,044 A 9/1992 DiSesa, Jr.
5,160,031 A * 11/1992 Palisin et al. ..... 206/519
5,160,061 A 11/1992 Stolzman
5,161,689 A 11/1992 Balson
5,163,576 A * 11/1992 Galer ..... 220/792
5,180,076 A 1/1993 Hundt
5,201,437 A * 4/1993 Burgdorf ..... B65D 1/20 206/515
5,215,207 A 6/1993 Stolzman
5,226,558 A 7/1993 Whitney et al.
5,285,892 A 2/1994 Adami et al.
5,383,558 A 1/1995 Wilkinson et al.
5,385,255 A * 1/1995 Varano et al. ..... 229/404
5,409,130 A 4/1995 Saunders
5,427,264 A 6/1995 Addison
5,489,036 A 2/1996 Arkins
5,495,941 A 3/1996 Leonard
5,499,438 A 3/1996 Schutz
5,607,075 A * 3/1997 Burgdorf ..... B65D 1/16 206/505
5,622,274 A * 4/1997 Bright ..... 215/246
5,626,049 A 5/1997 Saunders
5,638,977 A * 6/1997 Bianchi ..... B65D 55/06 215/273
5,671,856 A 9/1997 Lisch
5,779,035 A 7/1998 Marrelli et al.
5,785,201 A 7/1998 Bordner et al.
5,887,750 A 3/1999 Popp et al.
5,931,323 A 8/1999 Wilkinson et al.
5,944,214 A * 8/1999 Conti et al. ..... 220/304
5,947,320 A 9/1999 Bordner et al.
5,960,708 A 10/1999 DeTemple et al.
6,019,240 A 2/2000 Legeza
6,131,761 A 10/2000 Cheng et al.
6,138,863 A 10/2000 Aiken
6,213,301 B1 4/2001 Landis et al.
6,220,073 B1 4/2001 Cheng et al.
6,264,050 B1 * 7/2001 Darr et al. ..... 215/40
6,401,983 B1 6/2002 McDonald et al.
6,588,618 B1 7/2003 Davis
6,834,772 B1 * 12/2004 Thorsø ..... 220/795
6,874,650 B2 4/2005 Welsh et al.
6,994,216 B2 2/2006 Wong
7,014,078 B2 3/2006 Walsh et al.
7,036,693 B2 5/2006 Walsh et al.
7,837,036 B2 * 11/2010 Davis ..... B65D 1/26 206/505
2004/0060942 A1 * 4/2004 Luburic ..... 220/671
2004/0200839 A1 * 10/2004 Conti ..... B65D 25/2888 220/288
2005/0040068 A1 * 2/2005 Palder ..... 206/499
2005/0133515 A1 * 6/2005 Gutierrez et al. ..... 220/669

OTHER PUBLICATIONS

English-Language Translation of Office Action dated Mar. 12, 2010 for the corresponding Chinese patent application No. 200680032409.5.

English-Language Translation of Office Action dated Jun. 29, 2011 for the corresponding Chinese patent application No. 200680032409.5.

English-Language Translation of Office Action dated Oct. 24, 2011 for the corresponding Chinese patent application No. 200680032409.5.

English-Language Abstract of CN2409163Y from the European Patent Office.

* cited by examiner

SHIPPING CONTAINER

CROSS REFERENCE TO RELATED APPLICATIONS

The present application claims the benefit of the filing date under 35 U.S.C. § 119(e) from U.S. Provisional Application No. 60/696,639, filed Jul. 5, 2005.

TECHNICAL FIELD

Provided is a shipping container used for transporting and storing a wide variety of materials. More particularly, provided is a nestable shipping container for transporting and storing materials.

BACKGROUND

A large percentage of products used in the world either comprise materials transported or stored in conventional transport containers or are themselves materials transported or stored in conventional shipping containers. Some sources report this percentage as high as 85% of all products. As such, use and transport of these containers are important in global commerce. These containers are not usually considered disposable, as the general life cycle of conventional shipping containers includes reuse. Such reuse normally requires return of empty containers to a manufacturer where they are processed and refilled. As such, transport of these containers both in a laden condition (containing contents), and in the unladen condition (empty) is a very common shipping activity.

Transporting empty shipping containers has traditionally been by tractor trailer or railroad car. Unfortunately, transporting empty shipping containers is inefficient as the shipping volume of the trailer or railroad car, when filled with empty shipping containers, is dominated by the lost volume inside the containers. Thus, the transport agent is mostly hauling the air in the containers. The problem is compounded if the empty shipping containers are not nestable.

Attempts have been made to address this problem. In some limited instances, manufacturers shipping to one another may use and produce complementary products which the manufacturers ship to one another such that a shipping container flowing along transport lines between such manufacturers is always shipped in a laden form. For example, an agricultural products producer may ship corn syrup to an ethanol producer in the shipping containers, the ethanol producer then empties the shipping containers, fills them with ethanol, and ships them back to the agricultural products producer. Shipping containers in these commerce lines are always shipped laden such that the above noted inefficiency is minimized. Unfortunately, such complementary shipping arrangements are specialized and are very rare.

In the more common scenario, where it is not feasible to ship containers laden with products in both directions, it is desirable that shipping containers being shipped be arranged in such a manner that the number of shipping containers which can be stowed for shipping in a given volume be maximized. One manner in which to accomplish this end is to use nestable shipping containers. A nestable container is one which may be placed, at least partially, inside another similarly shaped shipping container.

Previous attempts at providing nestable shipping containers have been poorly received, because such containers have proven to be of poor integrity, prone to leakage, and unable to reliably comply with shipping container standards. This presents a major obstacle, as containers used in international commerce are required to be of sufficient integrity to pass certain international performance standards. In addition, it is been found to be difficult to separate previous nestable shipping containers from each other. Furthermore, previous nestable shipping containers are difficult to handle with conventional handling technology such as pallets, fork trucks, hand trucks, and in-house plant conveyor systems.

SUMMARY

Provided is a nestable shipping container comprising a cold worked, integral, tapered container body comprising an upstanding side wall, a bottom wall, and an open top.

According to certain embodiments, the nestable shipping container comprises a tapered container body comprising an upstanding side wall, a bottom wall, an open top, and a chime disposed at the upper end of said side wall of said container body, said chime comprising a flat top surface extending outwardly from said side wall of said container body.

According to other embodiments, the nestable shipping container comprises a cold worked, integral, tapered container body comprising an upstanding side wall, a bottom wall, and an open top, and projections extending outwardly from the bottom wall.

According to further embodiments, the nestable shipping container comprises a tapered container body comprising an upstanding side wall having an upper chime, a bottom wall, and an open top, a lid comprising a top plate, a skirt depending from said top plate, and a flange extending inwardly from a lower end of said skirt; and outwardly extending projections from said side wall of said container body for engaging said flange of said lid.

DETAILED DESCRIPTION

Figure 1A:
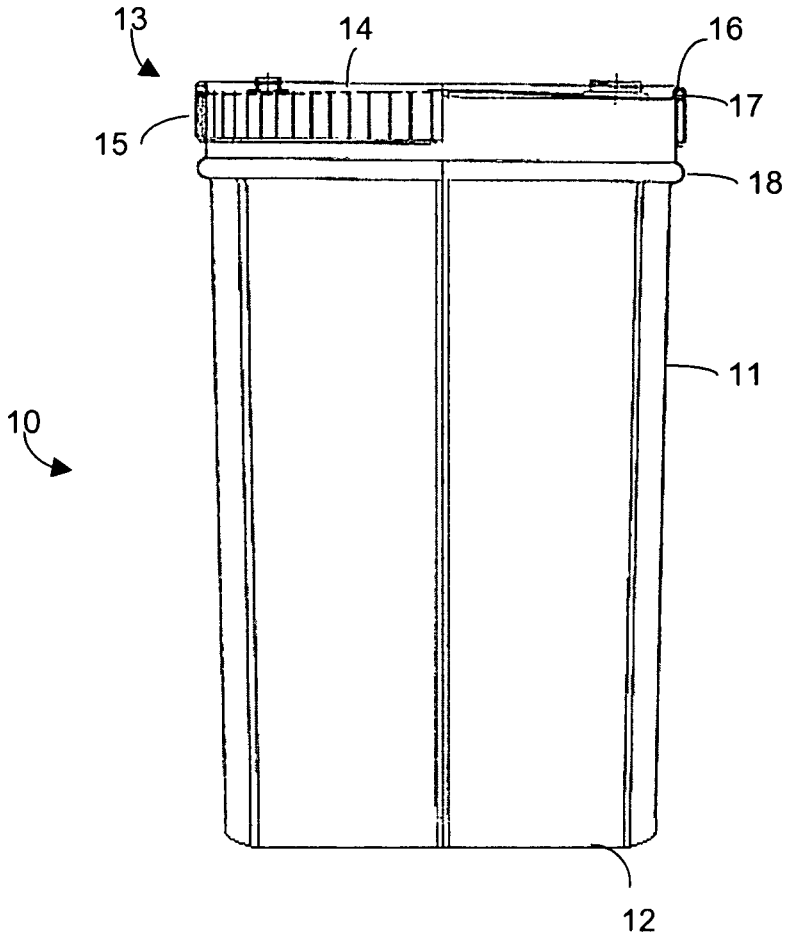
FIG. 1A is a section view of an illustrative embodiment of a nestable shipping container.

A shipping container comprising a side wall, a bottom wall, and an open top is disclosed. Together, the side wall, bottom wall and open top constitute a shipping container body. According to certain embodiments, the shipping containers may comprise 55 gallon or 70 gallon shipping containers. According to certain embodiments, the shipping container body is provided with a taper to facilitate nesting or stacking of a plurality of shipping containers.

The shipping containers may be nestable or non-nestable. The nestable containers necessarily comprise a self-nestable geometry. The geometry of a nestable container may include, without limitation, a geometry which is substantially conical or frusto-conical or which is substantially a polygonal pyramid or a truncated polygonal pyramid. Without limitation, in some embodiments the nestable geometry is a truncated square pyramid. Those skilled in the art will recognize that these geometries each have distinct and advantageous properties. In the case of a container having substantially conical or frustoconical geometry, it will have a very high radial crush strength and be a very tough, durable container. In the case of a container having a substantially square pyramid geometry, it will easily stand together with other containers in a side-by-side, rank and file, arrangement without creating wasted interstitial spaces so as to maximize storage volume for a given amount of floor space.

According to certain embodiments, the side wall and bottom wall are integral. As used throughout this specification, the term "integral" means that the side wall and bottom wall of the shipping container are manufactured as a single piece from a common blank of deformable material. As the side and bottom walls of the shipping container are manufactured from a single blank of deformable material, the traditional joining operations such as seaming and welding to connect the side wall and bottom wall manufactured from separate blanks of materials, are unnecessary.

According to other embodiments the side wall and bottom wall are not integral. In such embodiments, the side walls and bottom walls are manufactured from separate blanks of deformable material. Because these walls are manufactured from separate blanks, seaming or welding operations are necessary to connect the side wall to the bottom wall.

The upper end of the side wall of the shipping container includes a chime. The term "chime" as used in this specification is well known to those having ordinary skill in the art to refer to the upper edge or rim of a shipping container. As used herein, a chime refers to an edge or rim geometry which may be hollow or solid. In certain embodiments, and without limitation, a chime may be formed by rolling, stamping, or machining. According to certain embodiments, the nestable shipping container comprises a container body comprising an upstanding side wall, a bottom wall, and an open top, and a chime disposed at the upper end of said container body, which has a flat top surface that extends outwardly from the exterior surface of the side wall of the shipping container.

As described above, a chime is an expanded surface of a container fully or partially circumscribing the side wall perimeter. As noted above, the chime geometry may be either hollow or solid. In certain embodiments the chime is a rolled, tubular geometry comprising the top surface of the side wall. In some embodiments the chime is circular, that is, the cross-section of the chime is circular. In other embodiments, the chime has a flat surface, that is, cross-section of the chime has a flat surface. In some embodiments, the chime is a substantially closed cross-sectional geometry having a flat surface in which the flat surface of the chime is the top surface of the chime. In certain embodiments, where the chime has a flat top surface, the top surface of the chime is coplanar with the open top of the container.

The side wall of the shipping container, whether nestable or non-nestable, may also include elements to increase strength of the container. Without limitation, the strength-increasing elements may include vertically extending ribs or flutes in the side walls. The ribs of the side walls may be introduced into the side walls during the container drawing process, or they may be subsequently provided by a material expanding process in a single or progressive sequence.

The ribs may be of any width, height and thickness, depending on the desired additional strength to be imparted to the shipping container. Further, the number of ribs on the side walls may be chosen to provide a predetermined strength. The ribs may be formed by extrusion, drawing, stamping, or other operations. The ribs may be solid or hollow. The ribs may be internal, external, or both internal and external. Those of ordinary skill in the art will recognize that all of these described ribs will promote structural integrity. In certain embodiments, without limitation, the ribs are vertical and are integral to the side walls. Vertical ribs promote integrity and reliability. Vertical ribs increase the vertical load which a container may withstand without failure.

Also provided are means for facilitating nesting and denesting operations. Nestable containers may be nested tightly or loosely with like shaped containers. Provided are geometric elements, such as stacking rings, which allow tight nesting while facilitating denesting. The side wall of the nestable shipping container may include at least one stacking ring disposed about the outer circumference of the side wall of the shipping container. The stacking ring is typically located in the side wall of the shipping container at a position below the chime. According to certain embodiments, the stacking ring is located approximately 3 to 5 inches below the chime. Like the strength increasing ribs, the stacking ring may be introduced into the side walls during the container drawing process, or may be subsequently provided by a material expanding process in a single or progressive sequence.

Tight nesting is desirable for maximizing storage density, the number of containers which can be shipped within a given volume. Loose nesting promotes ease of nesting and denesting containers. In some situations, tight nesting can create difficulty in separating nested containers. Without being bound to any particular theory, such difficulty may result from connected surfaces or regions between containers which result in adhesive forces or from connected surfaces or regions between containers which result in cohesive forces, or from connected surfaces or regions between containers which result in isolation of internal regions from the external environment. These or other mechanisms may produce forces which resist denesting operations. Without being bound to any particular theory, some of the forces which resist denesting may result from air volumes trapped between nested containers. In order to avoid the production of forces which resist denesting operations, while still providing a high storage density, provided are geometric elements, such as stacking rings, which allow tight nesting but prevent, reduce, or break-up connected surfaces or isolated regions. Without being bound to any particular theory, maintaining flow paths for air between the exterior atmosphere and volumes within the nested containers, may reduce forces which resist denesting which result from air volumes trapped between nested containers. In certain embodiments, and without limitation, the geometric elements which allow tight nesting but prevent, reduce, or break-up connected surfaces or isolated regions comprise a stacking ring. The stacking ring is a geometry integral with the external geometry of the side walls forming a bump or ring or lobe or other eccentricities on the exterior surface of the side wall. In certain embodiments, the stacking ring is a horizontal ring about the perimeter of the sidewall located a predetermined distance below the chime of the side wall.

The stacking ring may be continuous about the entire circumference of the side wall of the shipping container. Alternatively, the stacking ring may include one or more discontinuity gaps. The discontinuous stacking ring may be a horizontal discontinuous ring or series of elongated lobes in a single horizontal plane located about the perimeter of the sidewall and further located a predetermined distance below the top edge of the side wall. Alternatively, the discontinuous stacking ring may be formed in the nature of a peak and valley structure about the side wall of the container body. Without limitation, by an expanding process the stacking ring portions are peaks and the spaces between each discontinuous stacking ring portion form valleys.

The vertical location of the stacking ring provides a limit to the amount to which a container may be inserted into a sister container. Limiting the amount to which a container may be inserted into a sister container, preserves a connection volume between internal and external spaces, prevents the isolation of internal regions from the external environment, and reduces forces that resist denesting operations. Limiting the amount to which a container may be inserted into a sister container also prevents, reduces, or breaks up connected surfaces or isolated regions and reduces forces which resist denesting operations. Further, leaving a margin at the top of each container facilitates grasping upon the container during nesting and denesting. In addition to functioning to promote ease of nesting and denesting stacking rings promote integrity and reliability. Horizontal stacking rings increase the radial load which a container may withstand without failure. Those of ordinary skill in the art will recognize that this increased radial load tolerance corresponds to a higher expected field life for the container.

For embodiments where the stacking ring includes one or more discontinuity gaps, the vertically extending ribs may pass through the stacking ring gap and terminate above the stacking ring.

The side wall of the nestable shipping container may also include elements to facilitate the transfer and storage of a stack of nested shipping containers. These elements are referred to as "base elements" or "feet." For the integral shipping containers, the feet of the shipping container are manufactured from the same blank of deformable material. For embodiments of the shipping container in which the side wall and bottom of the shipping container are manufactured from separate blanks, the feet are integral with the bottom wall. That is, the bottom wall includes the protruding feet.

Integral feet may be formed by protrusions from the bottom wall of the container. Without limitation, the protrusions forming the integral feet may be created by deep drawing processes. The geometry and positions of the feet may take diverse embodiments. In certain embodiments, the feet are a pair of parallel, substantially rectangular prisms protruding from and integrally connected to the bottom wall. The feet create a support surface for the container below the bottom wall such that the container need not rest upon the bottom wall. In some embodiments the feet are designed to facilitate access for fork truck forks to a lifting position under the container. In certain embodiments the feet are designed to facilitate access for hand trucks to a lifting position under the container. Because the feet permit access for handling equipment to engage and lift the container, palleting is not necessary.

The nestable containers also include a closure. Without limitation, in certain embodiments, such a closure comprises a top plate and engagement elements for releasably attaching the closure to the side walls or integral elements which are part of the side walls.

The closure may be releasably attached to the container by a snap-on connection, a threaded connection, or a bolt connection. In certain embodiments, the interface between lid and the container may comprise a sealing gasket or other seal promoter. In certain embodiments the closure may be releasably attached to the container by threads integral to the closure. In certain embodiments the closure may be releasably attached to the container by snap closure tabs.

In embodiments wherein the container comprises a chime there are embodiments for the engagement elements for releasably attaching the closure to engage the chime. In certain embodiments, the closure may be screwed or bolted to the chime. Corresponding holes for accepting the screws or bolts may also be provided in a surface of the chime, although this is not required. In such embodiments, a series of bolt holes are provided in the top plate of the closure corresponding to the position of holes for accepting the screws or bolts. In other embodiments, the fasteners are self-tapping screws so that making a separate tapping operation through the holes in the chime is unnecessary. In other embodiments, the fasteners are self-tapping, self-drilling screws so that they make both the holes and the thread for engagement so that neither a separate drilling operation to make the holes on the lid or chime nor a separate tapping operation to thread the holes, is necessary.

In certain embodiments the top plate of the closure conforms to the geometry of the chime such that the fastener shanks are not exposed. In certain embodiments the chime has a flat top edge coplanar with the top of the side walls such that the planar top plate conforms to the geometry of the chime such that the fastener shanks are not exposed. In embodiments where the chime has a flat top edge, creating and tapping precise holes to accept threaded fasteners is simpler than in embodiments where the chime has a curved top surface since a flat surface, unlike a curved surface, induces less random surface wander forces in a drill bit, fastener bit, or other tool or fastener contact point.

In certain embodiments, the closure may be releasably attached to the chime by threads integral to the closure. In such embodiments, the closure includes a top plate and a skirt depending from the top plate. In some embodiments, the skirt coincides with the perimeter of the closure. The skirt has an interior surface which has threads integrally attached to it. A set of mating threads are integral to the exterior surface of the side walls or to a geometry which is in turn integral to the side walls. In some embodiments the set of mating threads are integral to an exterior surface of a chime.

In certain embodiments wherein the closure is releasably attached to the chime by threads integral to the closure, the closure may further comprise notches, grooves, recesses, pins, studs, blocks, or other geometry to receive a tool for screwing the closure on or off. When in use the, tool improves leverage for applying a torque about the axis about which the lid rotates when being fastened or unfastened.

In certain embodiments, the closure may be releasably attached to the chime by snap closure tabs integral to the closure. In such embodiments, the closure includes a top plate and a skirt depending from the top plate. The interior surface of the skirt further includes an inwardly extending flange. In some embodiments, the skirt coincides with the perimeter of the top plate. Each flange has an upper and lower surface. Said upper surfaces releasably engage a downwardly facing engagement surface disposed on the side wall of the shipping container.

In embodiments where the container body is integrally formed from a single blank of deformable material, the closure may be attached to the chime by conventional seaming, conventional welding, or by a conventional bolt ring.

According to further embodiments, the lid may be provided with a top plate. The lid may include a plurality of spaced, crimped protrusions that are separated by spaced rim sections. The rim sections are turned under toward the center of the lid and are flat therewith. The crimped protrusions then screw into the straight top portion of the shipping container that has no chime by mating and interlocking with rounded off intermittent spiraling protrusions stamped out of the top portion the shipping container. A gasket is provided inside the lid protrusions to provide a leak-proof closure when subject to a screw-on motion under pressure.

The nestable containers may comprise metal, metal alloy, plastic, composite materials, or any combination of these materials. Composite materials are those material comprising matrix material and reinforcing material. Without limitation, composite materials include fiber-reinforced plastics and metal-filled plastics. Fiber reinforced plastics include glass-fiber filled plastics, such as glass fiber filled nylon.

According to certain embodiments, the nestable shipping container having integral side and bottom walls without seams or welds is manufactured by cold working a deformable material. Accordingly, the nestable shipping container may comprises cold worked metal, cold worked metal alloy, cold worked plastic, cold worked composite materials, and combinations thereof. According to an illustrative embodiment, the shipping container comprises cold worked steel.

The shipping containers have particular geometries or properties imparted by forming operations. Forming operations include, without limitation, cold working and hot working. Cold working operations are those operations which alter the shape or size of a material by plastic deformation and may be performed below the recrystallization point of the material. Without limitation, in certain embodiments, cold working operations may include rolling, stamping, drawing, and deep drawing. In drawing operations a blank is restrained at the edges, and the middle section is forced by a press into a die to stretch the metal into a cup shaped drawn part. Deep drawing is a particular kind of drawing operation. Deep drawing is an operation in which the depth of draw is equal to or greater than the smallest dimension of the opening. Many forming operations, including drawing operations, can be performed in a progressive manner. Progressive forming operations utilize a series of operations wherein the input for operations subsequent to the first operation are the output from prior operations.

By way of comparison, hot working operations are those which must be performed above the recrystallization point of the material. Hot working comprises molding operations. Molding operations include, without limitation, injection molding, blow molding, and vacuum molding.

Illustrative embodiments of the nestable container will be described in further detail with reference to the drawing FIGURES. It should be noted that the embodiments show in the drawing FIGURES are intended to be merely illustrative and should not be considered to limit the nestable container in any manner.

FIG. 1A shows one illustrative embodiment of nestable shipping container 10. Shipping container 10 includes side wall 11, bottom wall 12 and lid 13. Lid 13 includes top plate 14 with depending skirt 15. Lid 13 includes a raised rim portion 16 that is located about the outer perimeter of the top plate 14. The raised rim 16 defines a sealing element retention cavity 17. The side wall 11 of the container 10 includes a stacking ring 18 about the outer circumference of the side wall 11.

Figure 1B:
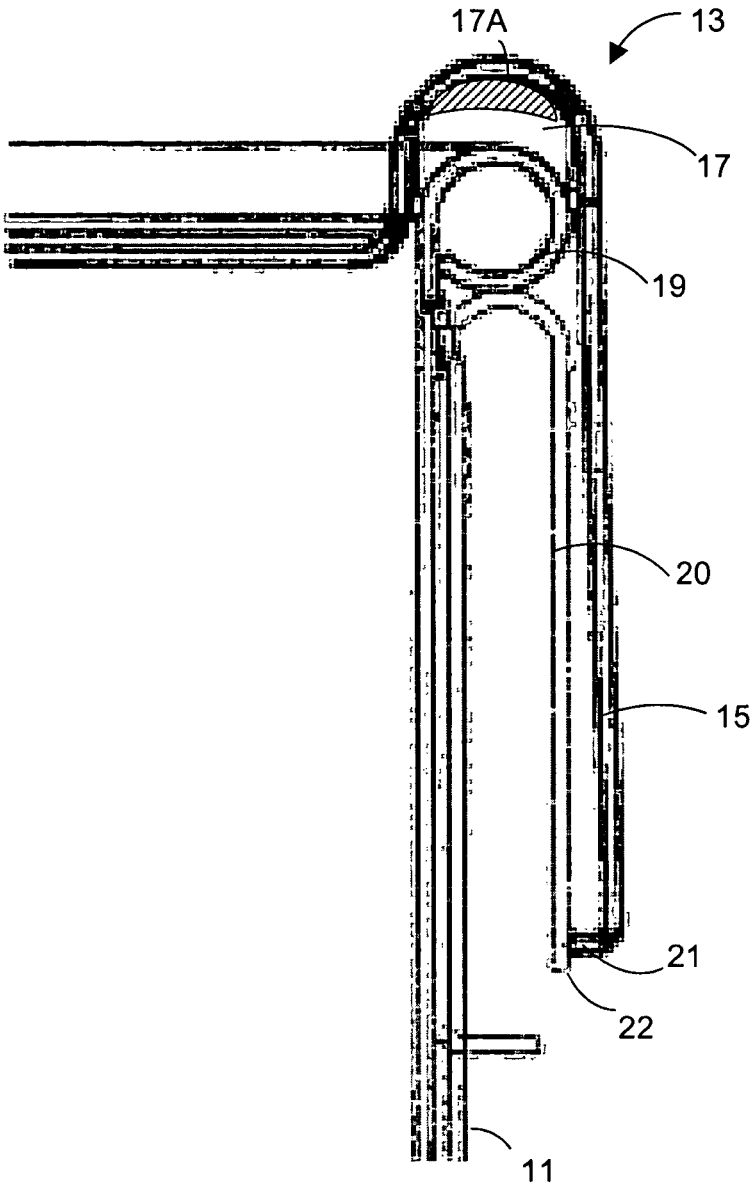
FIG. 1B is a cross-sectional view of an illustrative embodiment of a snap closure flange for closure engagement in the partially engaged condition.

FIG. 1B is a fragmentary view showing the connection of the lid 13 to the side wall 11 of the container 10. A closure engagement is designed to releasably hold the lid 13 in place over the open end of the container 10 of FIG. 1A. As shown in FIG. 1B, the upper end of the side wall 11 includes a rolled chime 19. Positioned below the chime 19 is the engagement element 20. FIG. 1B shows the closure engagement in the partially engaged condition. A sealing gasket 17A may be included within the sealing element retention cavity 17 to promote a seal between the lid 13 and the top edge of side wall 11 of the container 10. Skirt 15 includes an inwardly extending flange 21. The skirt 15 is shown slightly bent out of its free position as the flange 21 slides over the exterior surface of the engagement element 20. The downward facing engagement surface 22 of the engagement element 20 is shown disengaged from the flange 21.

Figure 1C:
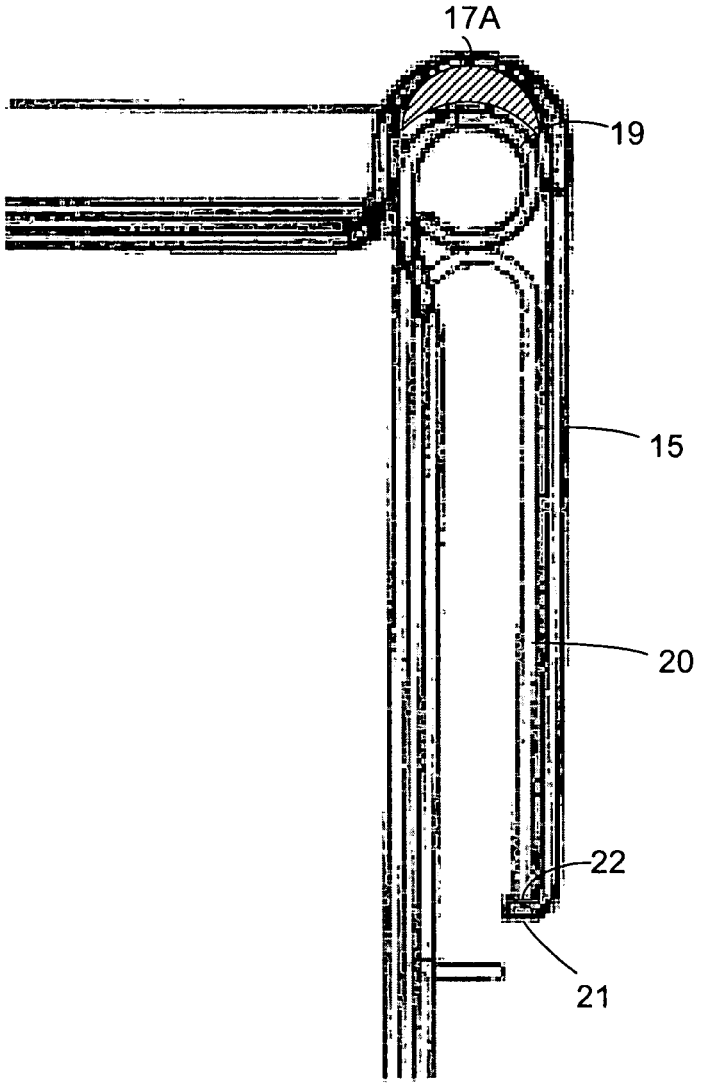
FIG. 1C is a cross-sectional view of an illustrative embodiment of a snap closure flange for closure engagement in the fully engaged condition.

FIG. 1C shows the illustrative embodiment of FIG. 1B in the fully engaged condition. The skirt 15 and closure flange 21 are shown in their free position as the flange 21 has cleared the exterior surface of the chime 19. The downward facing engagement surface 22 of the engagement element 20 is shown engaged with the flange 21.

Figure 2A:
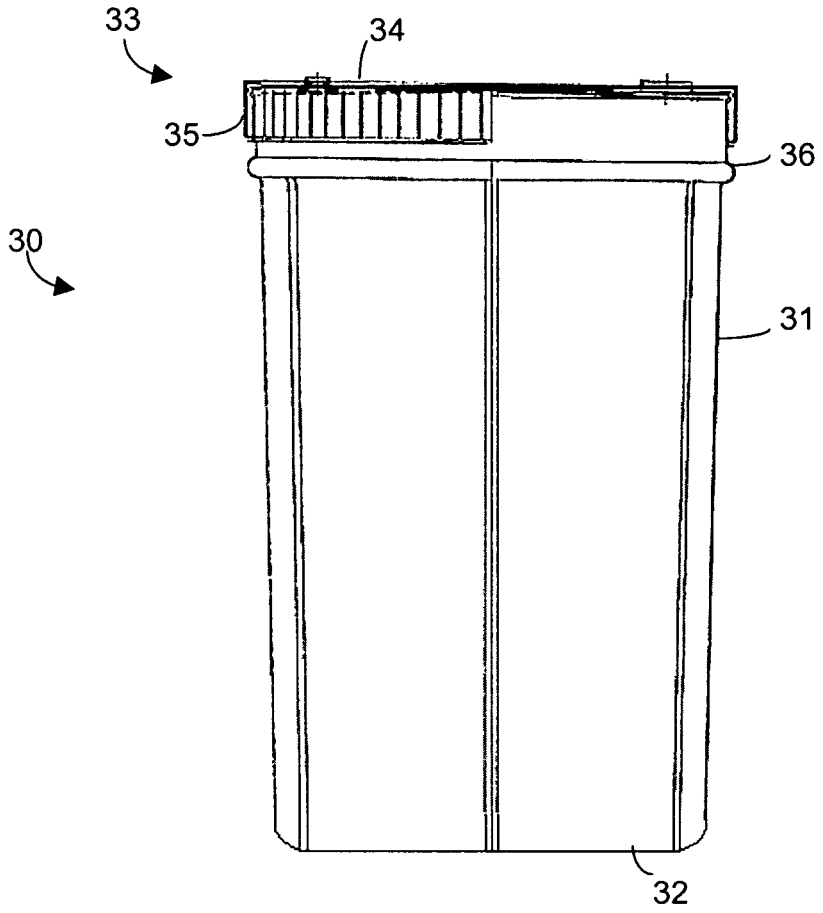
FIG. 2A is a section view of an illustrative embodiment of a nestable shipping container.

FIG. 2A shows another illustrative embodiment of the nestable shipping container 10, designated by reference numeral 30. Shipping container 30 includes side wall 31, bottom wall 32 and lid 33. Lid 33 includes top plate 34 with depending skirt 35. Unlike the shipping container 10 shown in FIGS. 1A-1C, the lid 33 does not include a raised rim portion located about the outer perimeter of the top plate 34. The side wall 31 of the container 30 includes a stacking ring 36 about the outer circumference of the side wall 31.

Figure 2B:
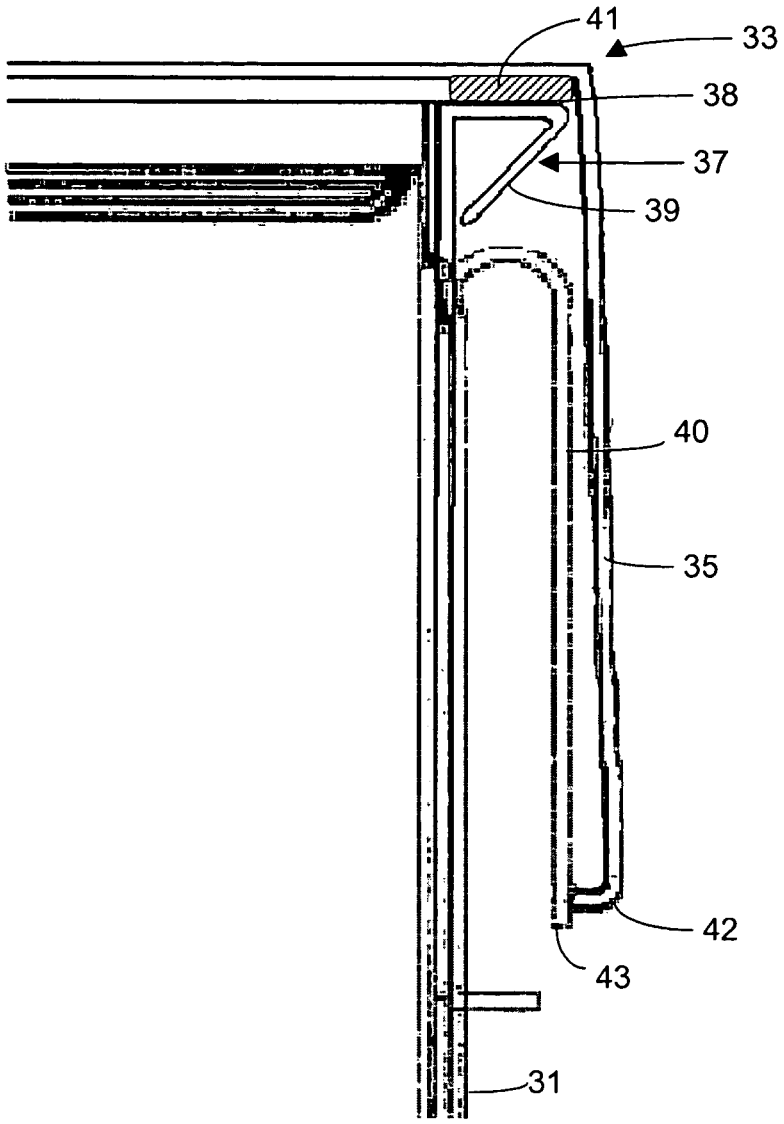
FIG. 2B is a cross-sectional view of an illustrative embodiment of a snap closure tab for closure engagement in the partially engaged condition.

FIG. 2B is a fragmentary view of FIG. 2A showing the connection of the lid 33 to the side wall 31 of the container 30. A closure engagement is designed to releasably hold the lid 33 in place over the open end of the container 30. As shown, the upper end of the side wall 31 includes a chime 37. Chime 37 includes a flat top surface 38 extending outwardly from the exterior surface of the side wall 31. Chime 37 also includes leg 39 which is bent back against side 31. Positioned below the chime 37 is the engagement element 40. FIG. 2B shows the closure engagement in the partially engaged condition. A sealing element 41, such as a gasket or an O-ring may be included along bottom surface of the lid 33 to promote a seal between the lid 33 and the top flat surface 38 of chime 37 of the container 30. Skirt 35 includes an inwardly extending flange 42. The skirt 35 is shown slightly bent out of its free position as the flange 42 slides over the exterior surface of the engagement element 40. The downward facing engagement surface 43 of the engagement element 40 is shown disengaged from the flange 42.

Figure 2C:
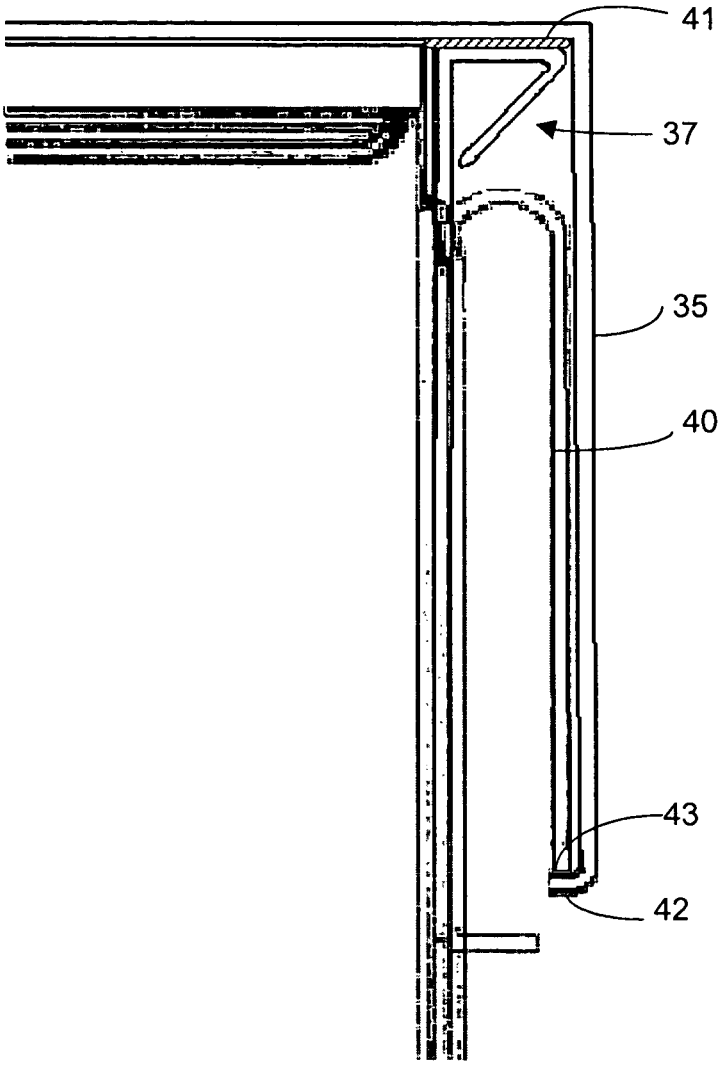
FIG. 2C is a cross-sectional view of an illustrative embodiment of a snap closure flange for closure engagement in the fully engaged condition.

FIG. 2C shows the illustrative embodiment of FIG. 2B in the fully engaged condition. The skirt 35 and closure flange 42 are shown in their free position as the flange 42 has cleared the exterior surface of the engagement element 40. The downward facing engagement surface 43 of the engagement element 40 is shown engaged with the flange 42.

Figure 3A:
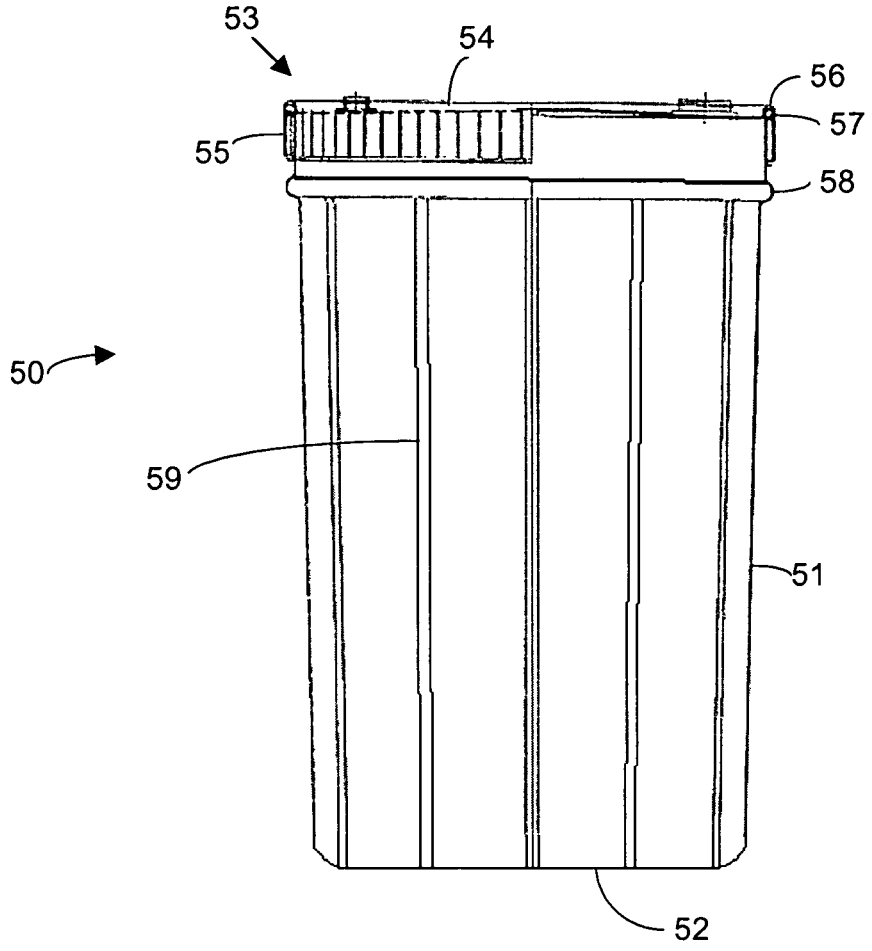
FIG. 3A is a sectional view of an illustrative embodiment of a nestable shipping container including vertically extending, external ribs.

FIG. 3A shows another one illustrative embodiment of a nestable shipping container, designated by reference numeral 50. Shipping container 50 includes side wall 51, bottom wall 52 and lid 53. Lid 53 includes top plate 54 with depending skirt 55. Lid 53 includes a raised rim portion 56 that is located about the outer perimeter of the top plate 54. The raised rim 56 defines a sealing element retention cavity 57. The side wall 51 of the container 50 includes a stacking ring 58 about the outer circumference of the side wall 51. The side wall 51 of shipping container 50 includes a plurality of vertically extending rib elements 59. Ribs 59 extend from the bottom wall of shipping container 50 to a position below stacking ring 58.

Figure 3B:
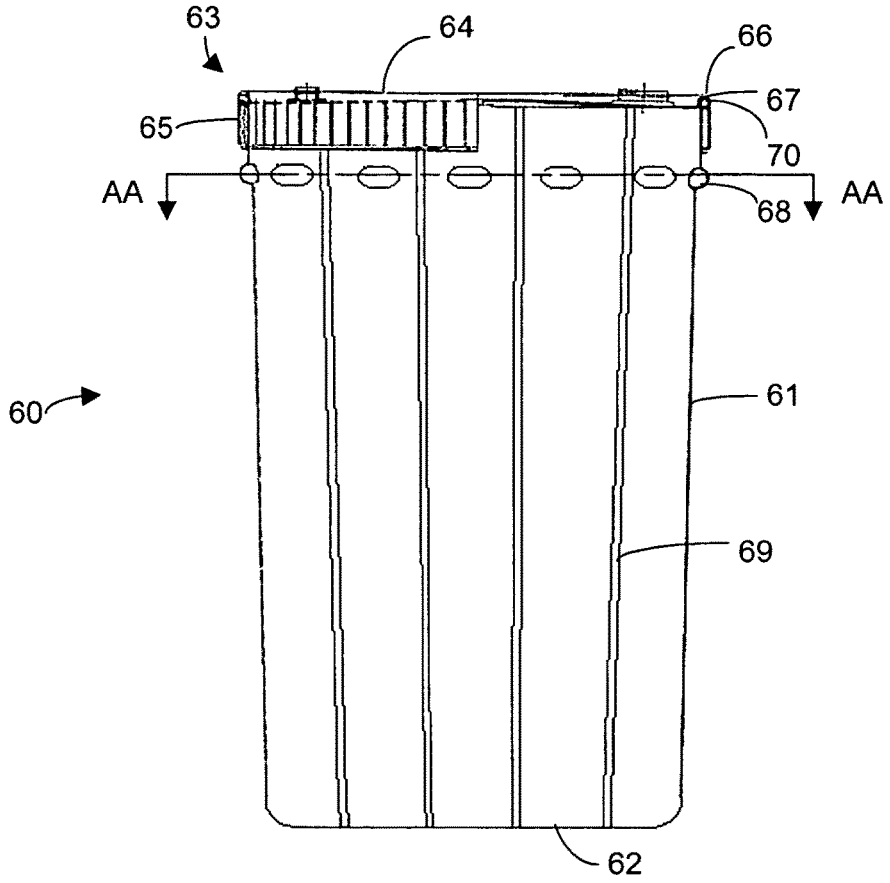
FIG. 3B is a sectional view of an illustrative embodiment of a nestable shipping container including external ribs vertically extending through spaces between a discontinuous stacking ring.
Figure 3C:
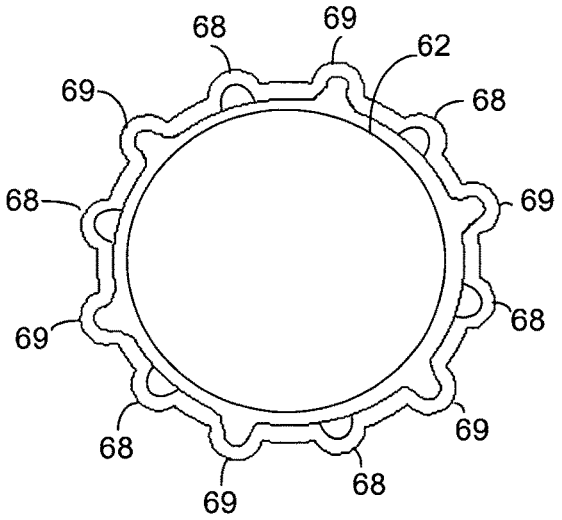
FIG. 3C is a cross section taken along AA-AA of the nestable shipping container shown in FIG. 3B.

FIG. 3B shows a variation of the illustrative embodiment of FIG. 3A. Shipping container 60 includes side wall 61, bottom wall 62 and lid 63. Lid 63 includes top plate 64 with depending skirt 65. Lid 63 includes a raised rim portion 66 that is located about the outer perimeter of the top plate 64. The raised rim 66 defines a sealing element retention cavity 67. The side wall 61 of the container 60 includes a discontinuous stacking ring 68 about the outer circumference of the side wall 61. Portions of the stacking ring 68 are horizontally spaced about the periphery of the side wall 61. The side wall 61 of shipping container 60 includes a plurality of vertically extending rib elements 69. Ribs 69 extend from the bottom wall of shipping container 60 and through the spaces between stacking ring 68 portions, and terminate at a position above stacking ring 68 but below chime 70.

Figure 4:
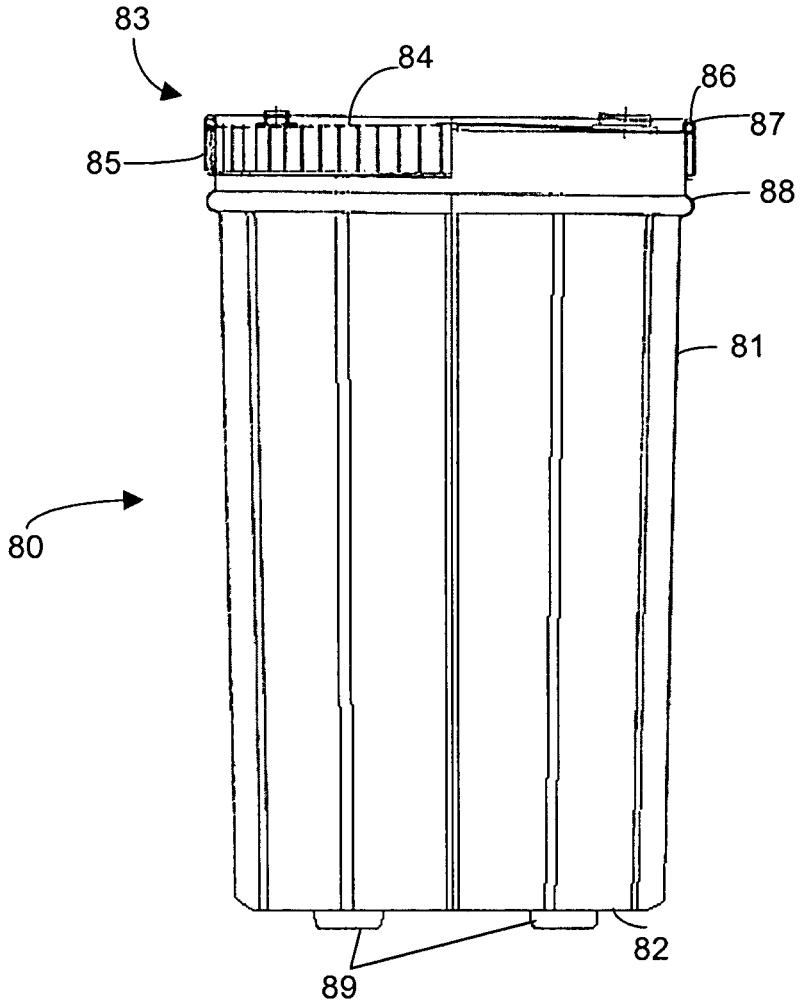
FIG. 4 is a sectional view of a nestable shipping container including feet elements.

FIG. 4 depicts an illustrative embodiment of a nestable shipping container, designated by reference numeral 80. Shipping container 80 includes side wall 81, bottom wall 82 and lid 83. Lid 83 includes top plate 84 with depending skirt 85. Lid 83 includes a raised rim portion 86 that is located about the outer perimeter of the top plate 84. The raised rim 86 defines a sealing element retention cavity 87. The side wall 81 of the container 80 includes a stacking ring 88 about the outer circumference of the side wall 81. Spaced apart feet 89 protrude from bottom wall 82.

The feet may be deep drawn from the bottom wall of the shipping container. The feet may also be provided with strength imparting ribs. The process for forming the ribbed feet would include deep drawing the feet from the single blank of material used for the side and bottom walls of the shipping container, and then pushing the feet into a mating die to impart the ribs in the feet. Thus, the ribbed feet would impart an additional strength increasing property to the bottom wall of the shipping container.

Assume a non-limiting embodiment of the shipping container having a about 20.0 to about 20.5 inch outer diameter. Without limitation, the shipping container could include feet having feet that are approximately 1 inch wide and 4 inches in height. The feet may be positioned approximately 3 inches from an edge of the bottom wall of the shipping container. This positioning of the feet would leave approximately 12.5 inches between the feet.

A shipping container or a stack of nested shipping containers can be transported or moved around a facility by either a hand truck, motorized forklift or any similar device that would allow a pallet or equivalent to move shipping containers. To move a single vertical stack of nested shipping containers, the forks of the hand truck or fork lift would be inserted in the space between the feet on the bottom wall of the shipping container. According to other embodiments, a number of shipping containers could be banded together to form a unit. The forks of the hand truck or fork lift would be inserted into the space between feet on adjacent shipping containers or on outermost feet of the shipping containers. Thus, the use of the feet on the bottom wall of the shipping container obviates the use of separate, wooden, plastic or metal pallets.

Figure 5A:
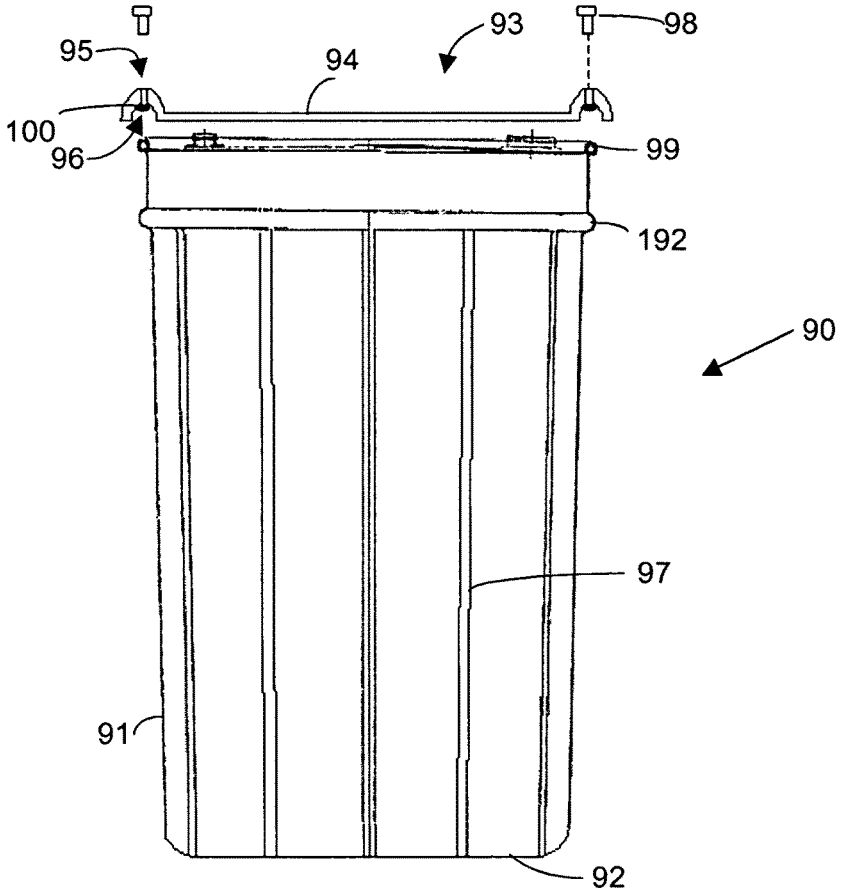
FIG. 5A is an exploded view of an illustrative embodiment of a nestable shipping container having a bolt-on closure.
Figure 5B:
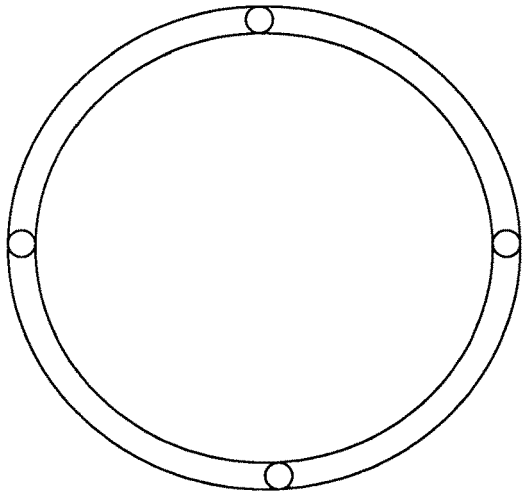
FIG. 5B is a view of an illustrative embodiment of a lid for a nestable shipping container having a bolt-on closure.

FIGS. 5A and 5B show an exploded view of an illustrative embodiment of a shipping container, designated by reference numeral 90. Shipping container 90 includes tapered side wall 91, bottom wall 92 and lid 93. Lid 93 includes top plate 94 and a raised rim portion 95 that is located about the outer perimeter of the top plate 94. The raised rim 95 defines a sealing element retention cavity 96. The side wall 91 of the container 90 includes a stacking ring 192 about the outer circumference of the side wall 91 and vertically extending ribs 97. Lid 93 includes a plurality of holes for receiving fasteners 98. Lid 93 is attached to the top of the shipping container 90 via fasteners 98. The lid 93 is positioned above the container 90 and the raised rim 95 of top plate 94 is brought into contact with rolled, tubular chime 99 located at the top of side wall 91. Sealing gasket 100 is located within the retention cavity 96 and therefore is disposed between the raised rim 95 and the chime 99. The fasteners are inserted into the holes in the raised rim 96 and are engaged with the chime 99. According to other embodiments, the chime 99 may also be provided with corresponding holes that are aligned with the holes in the raised rim 96.

Figure 6:
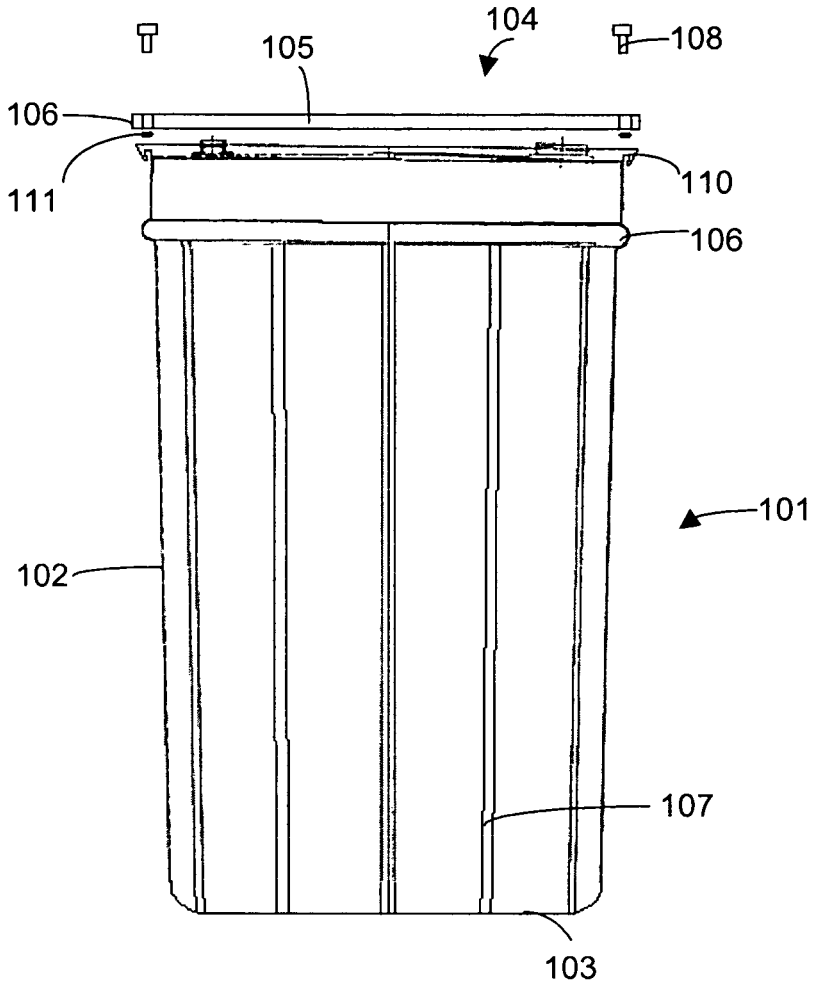
FIG. 6 is an exploded view of another embodiment of a nestable shipping container having a bolt-on closure.

FIG. 6 shows an exploded view of an illustrative embodiment of a shipping container, designated by reference numeral 101. Shipping container 101 includes tapered side wall 102, bottom wall 103 and lid 104. Lid 104 includes top plate 105 having an outer perimeter 106. The side wall 102 of the container 101 includes a stacking ring 106 about the outer circumference of the side wall 102 and vertically extending ribs 107. Lid 104 includes a plurality of holes for receiving fasteners 108. Lid 104 is attached to the top of the shipping container 101 via fasteners 108. The lid 104 is positioned above the container 101 and the outer perimeter 106 of top plate 105 is brought into contact with a flat chime 110 located at the top of side wall 102. Sealing gasket 111 is located near the outer perimeter 106 of top plate 104 and therefore is disposed between the outer perimeter 106 and the chime 110. The fasteners are inserted into the holes located near the outer perimeter 106 of top plate 104 and are engaged with the chime 110. According to other embodiments, the flat chime 110 may also be provided with corresponding holes that are aligned with the holes in the top plate 104.

Figure 7:
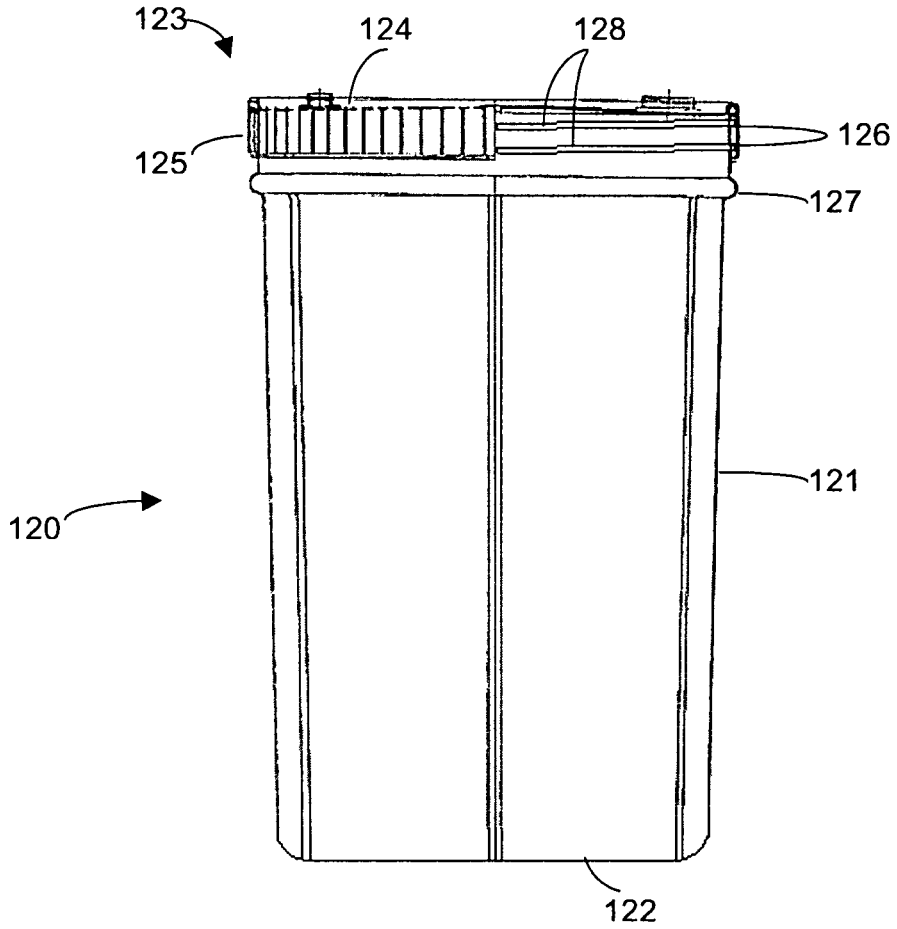
FIG. 7 is a view of an illustrative embodiment of a lid and body for a shipping container having a threaded closure.

FIG. 7 shows another illustrative embodiment of a shipping container, designated by reference numeral 120. Shipping container 120 includes side wall 121, bottom wall 122 and lid 123. Side wall 121 and bottom wall 122 are an integral structure manufacture from a single blank of deformable metal. Lid 123 includes top plate 124 with depending skirt 125. Skirt 125 includes interior and exterior surfaces. Located on the interior surface of skirt 125 are threads 126. The upper portion of the side wall 121 of the container 120 includes a stacking ring 127 about the outer circumference of the side wall 121. Disposed above stacking ring 127 are mating threads 128. Lid 123 is attached to shipping container 120 via mating threads 126 and 128.

Without limitation, the integral drum can serve as an overpack for shipping a wide range of smaller size shipping containers.

As used herein the term "international commerce drum" is a subset of containers which meets or exceeds certain performance criteria. More specifically, an international commerce drum is a container that does not leak or rupture or otherwise become unsafe to use as a container after being subject to any of the following: a drop of 0.8 meters onto a rigid, non-resilient, flat and horizontal surface; being held underwater and filled to a gauge pressure of 20 kPa for 5 minutes; being filled to a gauge pressure of 100 kPa for 5 minutes.

While the nestable container has been described above in connection with certain illustrative embodiments, it is to be understood that other similar embodiments may be used or modifications and additions may be made to the described embodiments for performing the same function without deviating therefrom. Further, all embodiments disclosed are not necessarily in the alternative, as various embodiments may be combined to provide the desired characteristics. Variations can be made by one having ordinary skill in the art without departing from the spirit and scope of the invention. Therefore, the nestable container should not be limited to any single embodiment, but rather construed in breadth and scope in accordance with the recitation of the attached claims.

I claim:

1. A nestable shipping container comprising: a cold worked, tapered container body comprising integral side and bottom walls without seams or welds and an open top, wherein said container body comprises substantially a truncated square pyramid geometry, wherein said side wall includes horizontally spaced, vertically extending ribs, wherein said container body further comprises at least one discontinuous circumferential stacking ring comprising a plurality of discontinuity gaps located in a horizontal plane about the perimeter of said sidewalls of said shipping container, and wherein one of said vertically extending ribs pass through each one of said discontinuity gaps and terminate above said discontinuous circumferential stacking ring.

2. The nestable shipping container of claim 1, wherein said container body further comprises flat-bottomed projections extending downwardly from the bottom wall.

3. The nestable shipping container of claim 1, wherein the upper end of said container body further comprises a chime having a flat top surface extending outwardly from said container body.

4. The nestable shipping container of claim 1, wherein said container body comprises a cold worked material selected from the group consisting of cold worked metal, cold worked metal alloy, cold worked plastic, cold worked composite materials, and combinations thereof.

5. The nestable shipping container of claim 4, wherein said container body comprises a cold worked metal alloy.

6. The nestable shipping container of claim 5, wherein said cold worked metal alloy comprises cold worked steel.

7. A shipping container comprising:

a container body comprising integral side and bottom walls without seams or welds and an open top, wherein said side wall includes spaced, vertically extending ribs; and a chime disposed at the upper end of said container body, said chime comprising a flat top surface extending outwardly from said container body;

wherein said container body comprises substantially a truncated square pyramid geometry;

wherein said container body is tapered to provide a nestable geometry; and wherein said container body further comprises at least one discontinuous circumferential stacking ring comprising a plurality of discontinuity gaps located in a horizontal plane about the perimeter of said sidewalls of said shipping container, and wherein one of said vertically extending ribs pass through each one of said discontinuity gaps and terminate above said discontinuous circumferential stacking ring.

8. The shipping container of claim 7, wherein said container body further comprises projections extending downwardly from the bottom wall.

9. The shipping container of claim 7, wherein said cold worked material is selected from the group consisting of cold worked metal, cold worked metal alloy, cold worked plastic, cold worked composite materials, and combinations thereof.

10. The shipping container of claim 7, wherein said container body comprises a cold worked metal alloy.

11. The shipping container of claim 9, wherein said cold worked metal alloy comprises cold worked steel.

12. A nestable shipping container comprising:

a cold worked tapered container body comprising integral side and bottom walls without seams or welds and an open top; and separate spaced-part flat-bottomed feet protruding downwardly from the bottom wall;

wherein said container body comprises substantially a truncated square pyramid geometry;

wherein said side wall includes horizontally spaced, vertically extending ribs; and wherein said container body further comprises at least one discontinuous circumferential stacking ring comprising a plurality of discontinuity gaps located in a horizontal plane about the perimeter of said sidewalls of said shipping container, and wherein one of said vertically extending ribs pass through each one of said discontinuity gaps and terminate above said discontinuous circumferential stacking ring.

13. The nestable shipping container of claim 12, wherein said container body further comprises a chime disposed at the upper end of said container body, said chime comprising a flat top surface extending outwardly from said container body.

14. The nestable shipping container of claim 12, wherein said container body comprises a cold worked material selected from the group consisting of cold worked metal, cold worked metal alloy, cold worked plastic, cold worked composite materials, and combinations thereof.

15. The nestable shipping container of claim 14, wherein said container body comprises a cold worked metal alloy.

16. The nestable shipping container of claim 15, wherein said cold worked metal alloy comprises cold worked steel.

17. A shipping container comprising:

a tapered container body comprising integral side and bottom walls without seams or welds and an open top, said side wall having an upper chime;

a lid comprising a top plate, a skirt depending downwardly from said top plate, and a flange extending inwardly from a lower end of said skirt;

wherein said container body comprises substantially a truncated square pyramid geometry, wherein said side wall includes space vertically extending ribs; and wherein said container body further comprises at least one discontinuous circumferential stacking ring comprising a plurality of discontinuity gaps located in a horizontal plane about the perimeter of said sidewalls of said shipping container, and wherein one of said vertically extending ribs pass through each one of said discontinuity gaps and terminate above said discontinuous circumferential stacking ring.

18. The shipping container of claim 17, wherein said projections are disposed below said chime.

19. The shipping container of claim 18, wherein said top plate further comprises an upstanding annular rim.

20. The shipping container of claim 19, wherein said closure comprises a seal promoter.

21. The shipping container of claim 20, wherein said seal promoter is a sealing gasket.

22. A nestable shipping container comprising a tapered container body comprising integral side and bottom walls without seams or welds and an open top, wherein said container body comprises a cold worked metal or metal alloy, wherein said container body comprises substantially a truncated square pyramid geometry, and wherein said side wall of said container body includes horizontally spaced, vertically extending, strength imparting ribs.

23. The nestable shipping container of claim 22, wherein said container body further comprises a pair of feet protruding from and integrally connected to said bottom wall of said container body.

24. The nestable shipping container of claim 22, wherein said shipping container further comprises a stacking ring and a chime located at the upper end of said container body, and wherein said stacking ring is located about the perimeter of the side wall of said container body and at a distance below said chime of said container body.

25. The nestable shipping container of claim 24, wherein said shipping container further comprises a lid having at least one hole through which a bolt may be passed to releasably attached said lid to said chime of said container body.

* * * * *